United States Patent [19]

Pierobon

[11] Patent Number: 5,025,733

[45] Date of Patent: Jun. 25, 1991

[54] RAILROAD SUPPORT TIE REPLACEMENT DEVICE WITH TRACK LOCKING DEVICE

[76] Inventor: Elio Pierobon, 300 Queen Street North, Thorold, Ontario, Canada, L2V 2P8

[21] Appl. No.: 449,714

[22] Filed: Dec. 12, 1989

[51] Int. Cl.[5] ..... E01B 29/06

[52] U.S. Cl. ..... 104/9; 104/7.1

[58] Field of Search ..... 104/2, 6, 9, 7.1, 258, 104/274

[56] References Cited

U.S. PATENT DOCUMENTS

| | | | |
|---|---|---|---|
| 2,908,228 | 10/1959 | Kershaw | 104/9 |
| 2,950,687 | 8/1960 | McWilliams | 104/9 |
| 3,146,727 | 9/1964 | Plasser et al. | 104/7.1 |
| 3,240,160 | 3/1966 | Blix et al. | 104/2 |
| 4,418,625 | 12/1983 | Allmer | 104/9 |
| 4,586,424 | 5/1986 | Nerlich | 91/6 |
| 4,655,633 | 4/1987 | Somero et al. | 404/75 |
| 4,770,103 | 9/1988 | Allmer | 104/9 |
| 4,850,630 | 7/1989 | Davies | 269/249 |

FOREIGN PATENT DOCUMENTS

| | | |
|---|---|---|
| 7821516 | 7/1978 | Fed. Rep. of Germany . |
| 2413855 | 7/1979 | France . |
| 34839 | 7/1977 | Italy . |

*Primary Examiner*—Robert J. Oberleitner
*Assistant Examiner*—S. Joseph Morano
*Attorney, Agent, or Firm*—Sommer, Oliverio & Sommer

[57] ABSTRACT

A railroad tie replacing device (10) including a support frame (11) on rollers (22) for movement over a series of parallel railroad tracks (28) supported by railroad ties (29). A main piston or cylinder (15) is positioned such that the stroke of the piston rod is horizontally toward and away from the rails. A gripping mechanism (23) is arranged on the main cylinder rod and is capable of gripping a railroad support to be replaced. The main cylinder and an attached spacer (24) for securing the invention to the rail during operation are lowered over the rail by a lift cylinder (18). Upon operation, the grippers are closed over a tie to be removed and the main cylinder is activated. The outward stroke of the main cylinder piston rod with appended gripper mechanisms pulls the tie from beneath the rails.

14 Claims, 3 Drawing Sheets

RAILROAD SUPPORT TIE REPLACEMENT DEVICE WITH TRACK LOCKING DEVICE

TECHNICAL FIELD

The present invention relates generally to the field of railroad and railroad track maintenance equipment and in particular, to an improved device for removing and inserting rail support ties.

BACKGROUND OF THE INVENTION

During the course of the operation of a railroad line, safety is an extremely important consideration, and it is especially necessary to provide and maintain the integrity of the actual rails and track area. As a result, a variety of devices and maintenance equipment have been developed to improve the efficiency of track maintenance procedures. For example, automatic snow removal and track laying equipment are routinely used to ensure operation of a rail line with only minimal inconvenience and interruption.

A particular problem that has been addressed in a variety of ways is the maintenance and replacement of the support ties (i.e., "railroad ties") over which the actual track rails run. Typically, a plurality of parallel track rails are supported by elongated wood or cement members (i.e., support ties) of rectangular cross section which are spaced beneath the rails perpendicular to the direction of rail travel. These support ties are usually embedded in a track bed of crushed stone or gravel. Often, because of the elements or through extended use, the support ties become damaged, warped or unstable. Accordingly, it is necessary to routinely extract and replace damaged support ties to insure the continued integrity of the rail line and overlying track rails. It is, of course, desirable to extract and replace damaged support ties quickly and efficiently without having to remove a length of actual track rail thereby rendering a particular track line inoperative for a period time.

Accordingly, various devices have been adopted to remove and replace support ties by securely gripping and then pulling a particular tie from beneath the track rails supported thereby. Many of these devices are heavy or mechanically bulky and require a maintenance locomotive or other similar railroad equipment for positioning and operation. These types of devices, of course, cause a particular track to be rendered inoperative since the track is effectively "blocked" to all other traffic during the course of maintenance operations unless a "side track" is close by. "Blocking" a length of track for any significant length of time is particularly undesirable in areas where no "side tracks" are conveniently located; e.g., in rural areas or between widely spaced destinations or in desolate and unpopulated areas. Thus, the "blocking" of an isolated line may result in total suspension of all traffic over such line and, in some cases, emergency conditions requiring re-routing of other, non-maintenance trains.

This problem has led to the development of various portable support tie extracting and replacing devices which may be transported to a particular track site either by maintenance train or by truck and placed upon a length of track by a work crew. These devices are generally adapted to be lifted and positioned through the use of conveniently located handles on the device. The devices typically comprise a light-weight skeletal support frame with wheels adapted to span the distance between the rails much like a locomotive or other track maintenance machine. Typically, mounted on the support frame are a series of pistons and cylinders used to secure a gripping mechanism to a particular tie to be removed and to provide a lateral or horizontal force to extract or insert the tie beneath the track rails. The prior art includes a number of similar patented devices which are described and operate in an almost identical manner; e.g., German Patent No. G-78 21 516.4 (Pierobon); Italian Patent No. 34.839 B/77 (Pierobon) and French Patent No. 7821163 (Pierobon). Each of these foreign patents describe and claim a portable device for replacing support ties using a series of pistons and cylinders.

Although the referenced patented devices and similar devices are relatively effective and efficient, numerous problems have been identified attendant to their continued use. In particular, the devices, primarily used in Europe, do not have the flexibility to be safely adapted and used with variable width track or track of special configuration. For example, depending on geographic location, track rails may be nine-inch or a six-inch gauge (or width) requiring a portable extractor to be adaptable to the variable widths. Also, safety considerations inherent to a particular track area (e.g., those attendant to double tracks on bridge crossings or to the merging of multiple tracks called "frog" connections) require flexible and adaptable means to secure the device to these various different track configurations during operation. The prior art does not have this flexibility either. As will be appreciated by one of ordinary skill in the art, the force generated by such devices is rather large (18,000 to 20,000 pounds) to enable the ties to be pulled from beneath the track and through the track bed without rail removal. Accordingly, it is essential that the replacement device be securely affixed to the top of the track rail during operation which is normally done through spacers (i.e., three-sided clamps attached to the device frame which fit over the rail width) to ensure safe operation. The known prior art does not have such securing means adaptable to meet all of these conditions; i.e., variable track width and different track configurations. This, of course, limits use of the prior art devices to specific track conditions.

Moreover, the devices described in the known prior art also fail to address other undesirable, unsafe conditions. For instance, the hoses connecting the hydraulic control systems and fluid sources to the various cylinders described in the prior art are often exposed unnecessarily. In particular, the devices require that certain hoses be capable of extending a distance equal to the stroke of certain pistons and cylinders. This results in the hoses being extraordinarily long and therefore susceptible to rupture or damage during and after operation.

In addition, although the prior art devices are apparently portable, none are equipped with appropriate safety release valves or other means for quickly removing the grippers or the secured frame from the track if the engine powering the piston seizes or malfunctions during operation. Accordingly, in the event of a breakdown, it is often the case that the prior art devices, although portable, effectively "block" the track much like bulky or locomotive powered devices until their engine can be repaired.

Accordingly, the invention solves these problems by providing a means for securing the device to various types of track or track configurations and further, providing a hose reel to automatically coil any excess hose, as well as a safety release valve and reservoir for releasing pressure in the cylinders in the event of malfunction or emergency, independent of engine operation.

DISCLOSURE OF THE INVENTION

The present invention comprises a support tie replacement device and includes a support frame (e.g., 11) spanning the distance between two or more parallel railroad track rails (e.g., 29) which are in turn supported by spaced support ties (e.g., 28) positioned beneath and perpendicular to the direction of travel of the overlying rails. The support frame rests on wheels (e.g., 22) arranged to roll over the top width (e.g., W) of the rail surface. The improvement further includes an engine (e.g., 13), a fluid pump (e.g., 14) and fluid reservoir (e.g., 12) arranged to provide fluid through a hydraulic control system (e.g., 19) and connector hoses (e.g., 20) to a main piston and cylinder (e.g., 15), gripper piston and cylinder (e.g., 16) and lift piston and cylinder (e.g., 18) also arranged on the support frame. One of ordinary skill in the art will readily appreciate that although the preferred embodiment employs pistons and cylinders, any type of actuator or actuator having a rod with a stroke length may be used with the invention.

A gripper mechanism (e.g., 23) for securely gripping the tie to be extracted is arranged at the end of the main cylinder piston rod. The gripper mechanism is actuated by the gripper cylinder which, when actuated, causes the facing gripper disks (e.g., 31, 31A) to close on opposite sides of the tie. Horizontal and pivotally mounted main cylinder 15, which is suspended at the end of lift cylinder 18 is lowered onto the rail and is secured by a series of adaptable spacers (e.g., 24) adapted to clamp over the rail top width. When in position, the main cylinder, to which the gripping mechanism is attached, is actuated and the resulting outward stroke of the piston rod effectively pulls a tie from beneath the track. Similarly, a tie may be inserted by reversing the stroke of the piston rod.

The gripper cylinder connector hoses (e.g., 21, 21A) are automatically fed and retracted through the use of a pair of spring-biased hose reels (e.g., 25) mounted on the frame dependent upon the stroke of the main cylinder piston rod. Similarly, a safety release valve (e.g., 26) operates independent of the engine and is capable of releasing fluid from the cylinders back to the reservoir upon a malfunction or seizure of the engine.

Accordingly, the general object of the invention is to provide an improved portable support tie extractor.

Still another object of the invention is to provide a portable extractor that is adapted to be secured during operation to track rails of variable width and configuration.

Still another object of the invention is to provide a safer portable support tie extractor including a spring-biased hose retractor and special release valve.

These and other objects and advantages will become apparent from the remainder of the written specification, the drawings, and the appended claims.

MODES OF CARRYING OUT THE INVENTION

Figure 1:
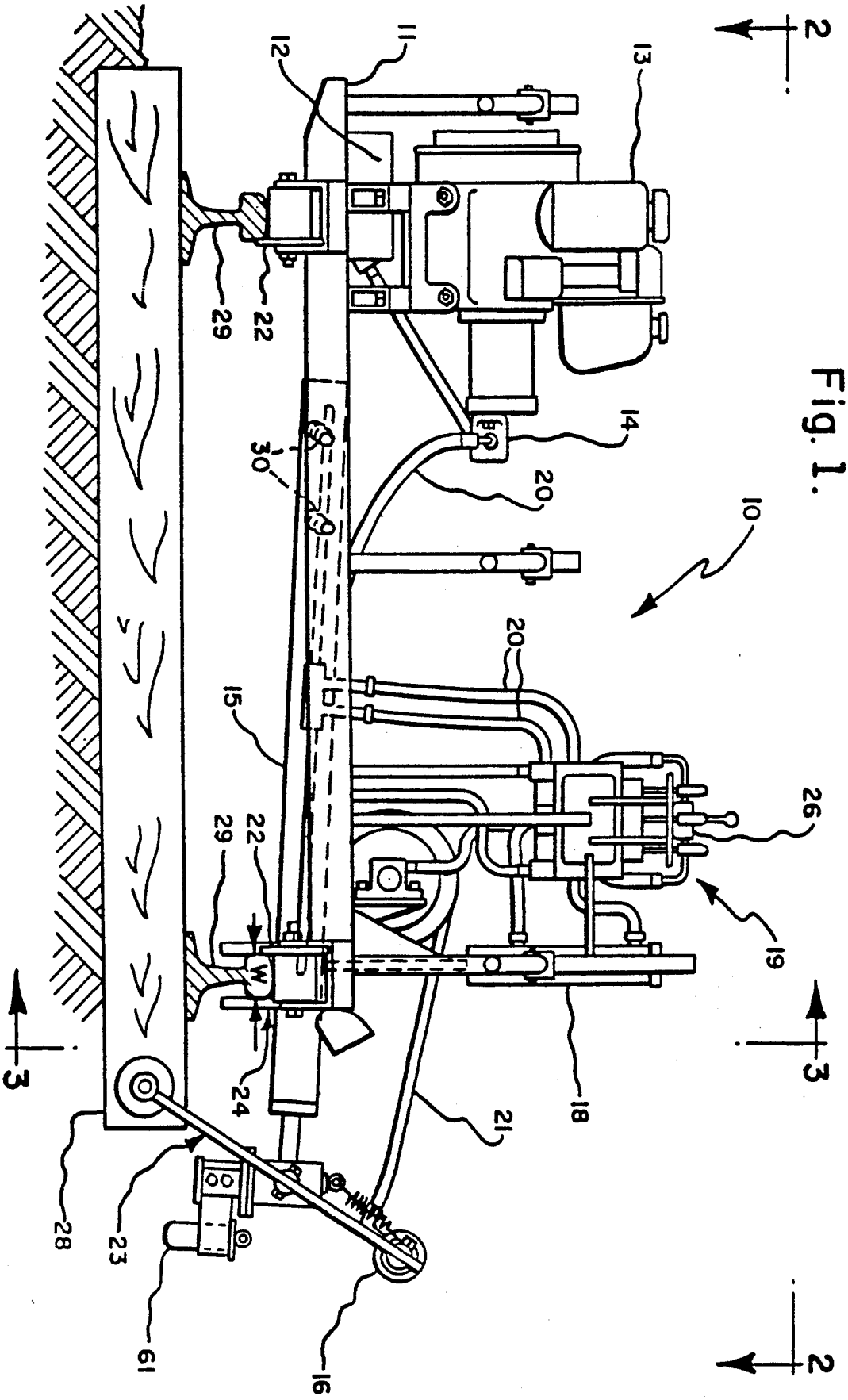
FIG. 1 is a side elevational view of the invention.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 2:
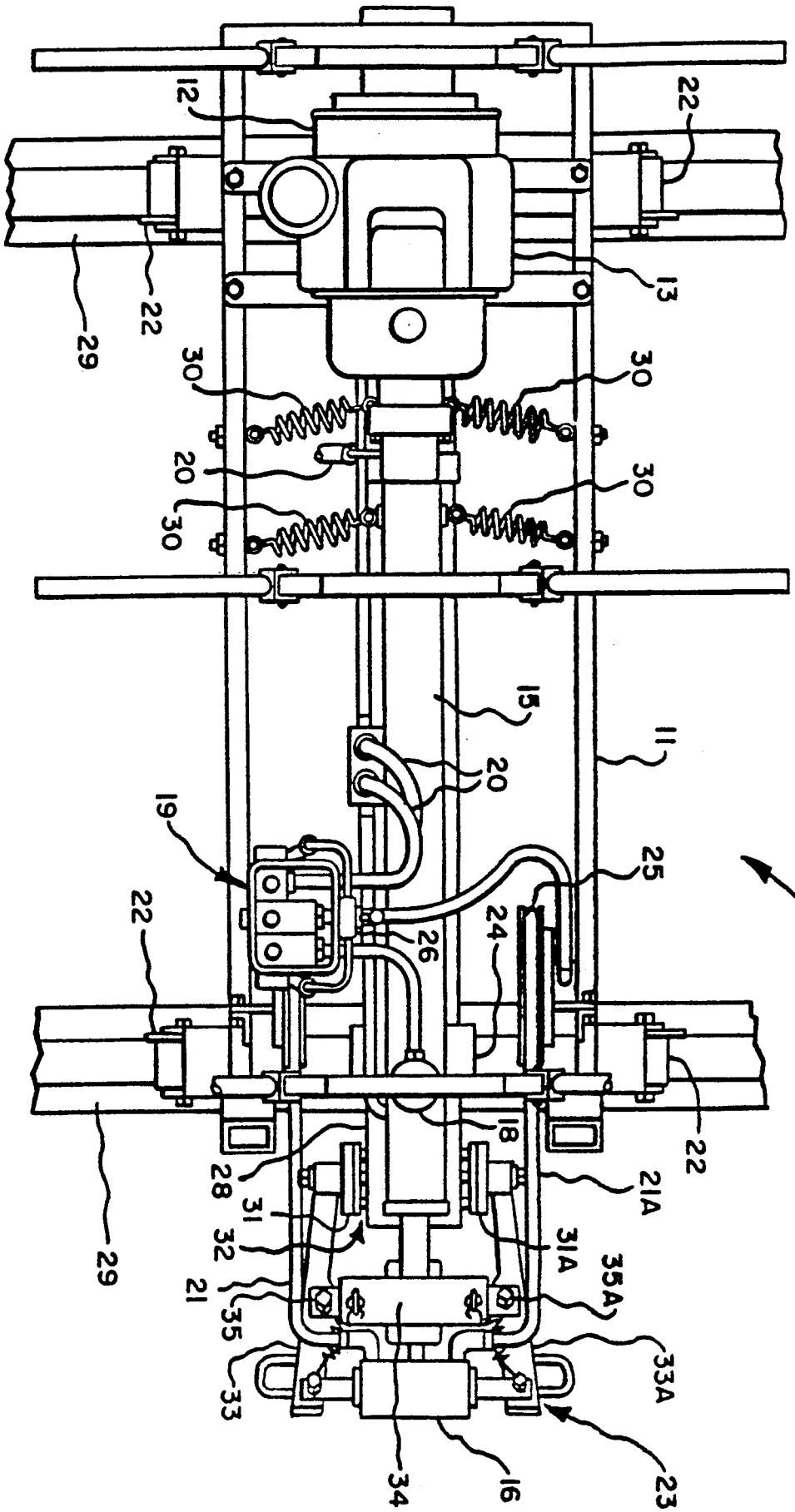
FIG. 2 is a top plan view of the invention.
Figure 3:
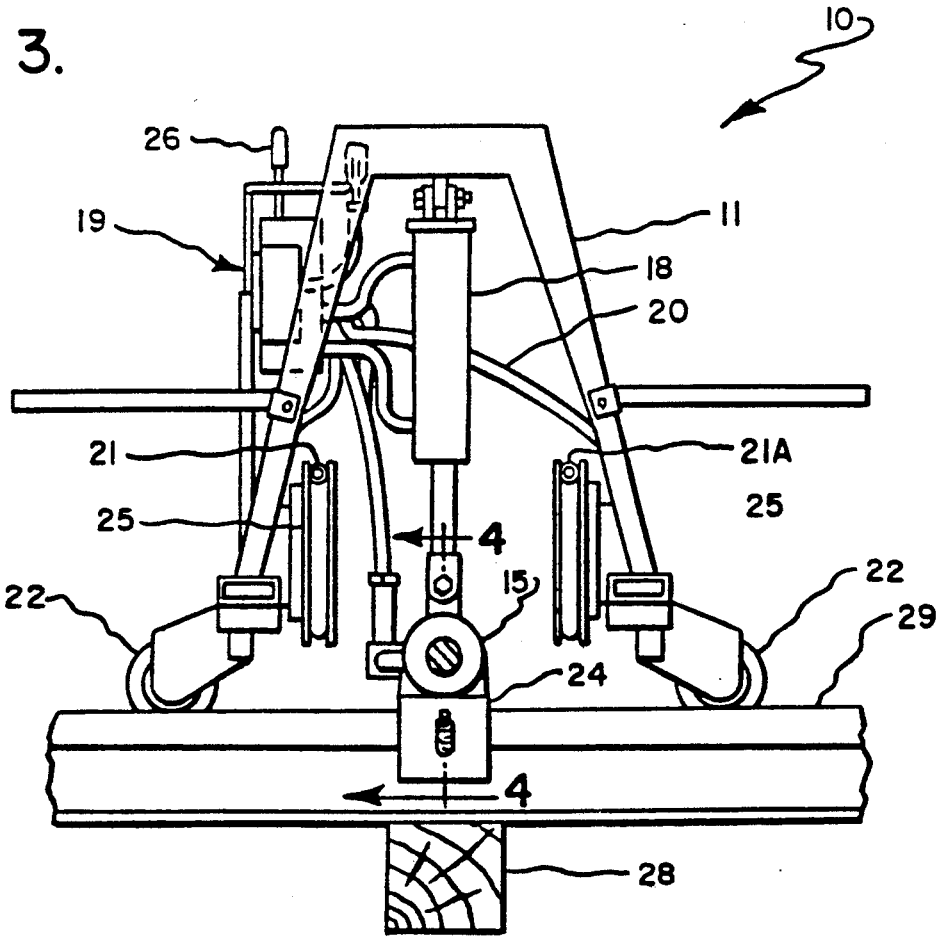
FIG. 3 is a transverse sectional view of the invention taken along 3—3 of FIG. 1 showing the lift cylinder and main cylinder.

Adverting first to FIG. 1, the invention 10 is shown to include a support frame 11, effectively spanning the distance between two or more parallel railroad track rails 29, and adapted to support the remaining working components of the improved device. As shown in FIG. 2, support frame 11 is generally rectangular and is constructed of steel or any other suitable alloy capable of supporting the components and withstanding the operational stresses of the invention. Nonetheless, it is desirable to choose a metal or other alloy that is strong, yet light, since the invention is generally capable of being moved into place through the use of handles (not shown) by a crew of four or five operators. Referring to FIGS. 1 and 2, support frame 11 is shown to be supported by wheels 22 which rotate over the top width, W, of track rail 29. The track is supported by a plurality of spaced perpendicular railroad support ties 28 which span the distance between the parallel rails at relatively even intervals for the length of the rail line. As shown in FIG. 3, support tie 28 is, in cross section, a square or rectangular member. As previously discussed it is desirable to periodically replace support ties as part of routine track maintenance without removing the overlying rails. This is accomplished through the use of a gripper assembly 23 arranged on main piston and cylinder 15, which together, work to "grip" a particular support tie and "pull" the tie from beneath the overlying rails.

Adverting now to FIG. 1, the invention is shown to include, mounted on the support frame, a gasoline engine 13 which powers a fluid pump 14 connected to a fluid reservoir 12 and to hydraulic control assembly 19 through connector hoses 20. Hydraulic control assembly 19 typically includes a series of individually controlled valves or gates (not shown) which may be selectively activated to provide pumped fluid to each of the piston and cylinders. In particular, gripper cylinder 16, having dual pistons in the preferred embodiment, is supplied at either of its ends through gripper cylinder connector hoses 21, 21A as is shown in FIG. 2.

Adverting to FIGS. 1 and 2, gripper assembly 23 is shown to be attached to the end of the piston rod of main cylinder 15 and is operatively arranged to be capable of "clamping" onto tie 28. In particular, as shown in FIG. 2, the gripper assembly is comprised of two facing and spaced cylindrical disks 31, 31A each having a plurality of cleats 32 for securely gripping the sides of a support tie. The disks are generally rotatably mounted through the use of bearings (not shown) on a pair of elongated support members 33, 33A. The support members are operatively affixed to the support frame at their approximate mid-point at opposite ends of elongated primary support member 34. In particular, the support members are pivotally attached at each end of the primary member through the use of bolts 35, 35A thereby enabling the appended disks to move toward and away from one another and therefore toward and away from the sides of a particular support tie. Continuing to advert to FIG. 2, the upper ends of support members 33 and 33A are mounted at either end of the piston rods of dual piston gripper cylinder 16. Accordingly, as the dual pistons are powered outwardly by the incursion of fluid into the gripper cylinder chambers, the pivotally mounted support members force the disks and attendant cleats inward causing the cleats to "clamp" onto the sides of a particular tie 28 to be removed. Upon engagement of the gripping mechanism with the particular support tie to be extracted, the main cylinder 15 is then actuated to effectively "pull" the tie from beneath the track rails.

Specifically, as shown in FIGS. 1 and 2, main cylinder 15 is arranged parallel to the length of support frame 11 and support tie 28 and perpendicular to the direction of travel of rail 29. The main cylinder is pivotally mounted at the engine end of the support frame and is supported at its mounted end by a plurality of springs 30 extending inwardly from the sides of the support frame. Adverting to FIGS. 1 and 3, the main cylinder is shown to be supported at its other end by lift cylinder 18. In particular, lift cylinder 18 is vertically mounted above the main cylinder and is connected, at its piston rod end, to the top of the main cylinder. Accordingly, the piston rod stroke of lift cylinder 18 in effect raises and lowers the pivotally mounted main cylinder toward and away from the top surface of rail 29. As a result, the stroke of the lift cylinder directly determines the horizontal position of main cylinder 15 and accordingly, the substantially horizontal direction of the stroke of the main cylinder piston rod. Thus, the lift cylinder is used to position the main cylinder with its connected gripper assembly over a particular track and support tie to be extracted as is generally shown in FIG. 3.

Figure 4:
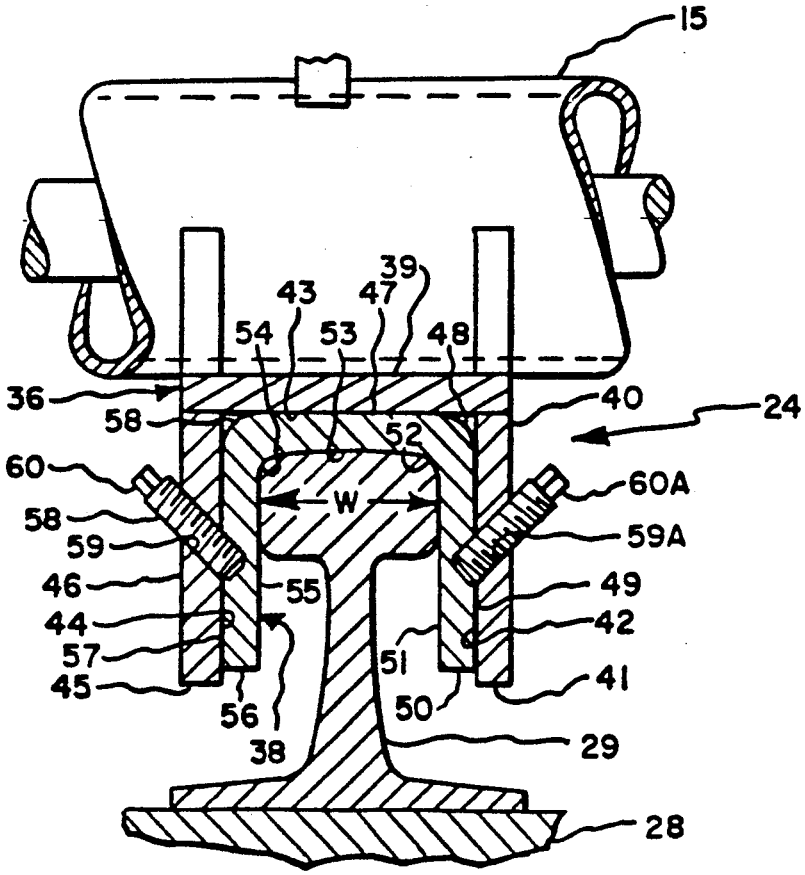
FIG. 4 is an enlarged longitudinal sectional view of the main cylinder and attached spacer taken along 4—4 of FIG. 3.

Adverting now to FIGS. 1,3 and 4, the invention is shown to further include a spacer 24 operatively attached to the bottom surface of main cylinder 15 at a point substantially directly over the width W of rail 29. Spacer 24 serves to secure the support frame and attendant components to the track when the invention is in operation. Adverting specifically to FIG. 4, in the preferred embodiment, the spacer is shown to be comprised of two components; i.e., outer component 36 and an inner component 38, operatively arranged to fit one within another and adapted to fit over rail width, W. Both the outer and inner components are relatively thick-walled, heavy gauge steel, integrally formed generally U-shaped members. Outer component 36 is specifically welded or otherwise affixed to the bottom of the main cylinder above rail width W.

Continuing to advert to FIG. 4, spacer outer component 36 is shown to specifically include a horizontal planar top surface 39; vertical downwardly extending planar surface 40; horizontal leftwardly extending planar surface 41; vertical upwardly extending planar surface 42; horizontal leftwardly extending planar surface 43; vertical downwardly extending planar surface 44; horizontal leftwardly extending planar surface 45 and vertical upwardly extending planar surface 46.

Similarly, inner component 38 is shown to be comprised of horizontal planar top surface 47; downwardly facing concave surface 48; vertical downwardly extending planar surface 49; horizontal leftwardly extending planar surface 50; vertical upwardly extending planar surface 51; downwardly facing concave surface 52; horizontal leftwardly extending substantially planar surface 53; downwardly facing concave surface 54; vertical downwardly extending planar surface 55; horizontal leftwardly extending planar surface 56; vertical upwardly extending planar surface 57 and downwardly facing concave surface 58.

Continuing to advert to FIG. 4, it can be readily seen that the width of the outer component is greater than that of the inner component and accordingly, the outer component is able to fit over the inner component. When in place, the inner component and outer component are held together by angled through holes 59, 59A drilled through the side thickness of the outer component and approximately halfway through the side thickness of the inner component. A pair of set pins 60, 60A are inserted into the aligned through holes thereby "locking" the inner component within the outer component.

The width of the inner and outer components of the spacer is variable and is devised according to the typical track gauge (usually nine inch or six inch) in a particular location. Moreover, the width of the spacer components can be varied to accommodate "double safety tracks" generally used on bridge crossings or "frogs" (i.e., areas where a number of tracks merge at various angles) or other special track configurations to enable the invention to be secured to these special tracks for safe and efficient operation. Moreover, through the use of the through holes and companion pins, it can be readily appreciated that the spacer can be easily and quickly adapted "on-site" to accommodate a particular track configuration or size. Specifically, the spacer width can be varied (i.e., the inner component is either removed or added) prior to lowering of the main cylinder over the track. Once the bottom surface of the spacer (e.g., 36 or 38) contacts the top surface of the rail, the lift cylinder is locked into position thereby securing the support frame to the track in a position for operation of the invention. Accordingly, the lift cylinder not only positions the main cylinder in an appropriate horizontal direction for replacement of a particular tie, but also serves to lower the spacer of pre-selected width (attached to the bottom of the main cylinder) over the track rail thereby securing the invention during operation. When placed in position over the track rail, the spacer keeps the invention secured to the track by absorbing the lateral forces and torque generated by the main cylinder as the stroke of its piston and rod pulls a tie from beneath the overlying rails.

Adverting now to FIGS. 1 and 3, the invention is also shown to include a pair of spring biased hose reels 25 affixed to either side of the support frame a short distance behind the gripper cylinder 16. The hose reels are adapted to automatically feed and retract gripper cylinder connector hoses 21, 21A, as the stroke position of the piston rod of main cylinder 15 varies. Thus, gripper cylinder connector hoses 21, 21A must be sufficiently long to extend from the hose reels to the gripper cylinder when the main cylinder rod is at the end of its stroke and accordingly, when the gripper mechanism 23 is at its furthest distance from the support frame and track rail. The hose reels insure continued safe operation of the device since the minimum amount of pressurized hose is exposed during the course of the extraction or replacement of a particular tie thereby avoiding inadvertent rupture or other damage caused by vibration, debris, etc.

Adverting to FIGS. 1, 2 and 3, the invention is further shown to generally include a release valve 26, affixed to the hydraulic assembly 19, capable of providing a manual release of the fluid pressure in each of the cylinders independent of the functioning or malfunctioning of the engine. Accordingly, in the event the engine "seizes" or otherwise ceases functioning during the extraction or insertion of a support tie, the invention may be readily removed from the track by activation of the release valve and by manually removing the grippers and raising the main cylinder and connected spacer from the track rail. Thereafter, the support frame can be lifted off the track thereby freeing the track for the passage of other trains or railroad equipment until engine repairs can be made.

In operation, the invention is rolled or positioned over a particular railroad support tie to be replaced by the pushing or placing of the support frame in an appropriate position on the rails. Thereafter, as shown in FIGS. 1 and 3, the main cylinder is aligned over and parallel to the tie to be replaced. The lift cylinder is then engaged to lower the main cylinder and attendant properly selected spacer over the rail width W. The correct spacer is, of course, selected prior to actuating the main cylinder and positioning the main cylinder and will depend upon the width or configuration of the track supported by the tie to be replaced. Thereafter, gripper disks 31, 31A are positioned on either side of the tie to be removed and the cleats are aligned thereby. Gripper cylinder 16 is then actuated and the disks and cleats are pivotally forced into solid engagement with opposite sides of the support tie to be removed through the action of the dual piston rods and primary support members. Accordingly, at this point, the support frame and device is firmly affixed to the track through the lowering of the first cylinder and spacer and also, the support tie to be removed is firmly held by the gripper disks secured into position by gripper cylinder 16. Thereafter, main cylinder 15 is actuated and an outward stroke of the piston rod initiated. The outward force provided by the piston rod stroke (to which the gripper assembly is attached) "pulls" the tie from beneath the track rails. Typically, the main cylinder is capable of producing between 18,000 and 20,000 pounds of force horizontally away from the track rail and accordingly, sufficient force is available to remove a particular support tie as desired. Moreover, the stroke length of the main piston and cylinder is calibrated to be more than sufficient to entirely remove the tie from beneath the tracks.

Each of the pistons and cylinders required for operation of the device are individually activated and controlled by the hydraulic control mechanism 19 which is supplied with fluid through the engine, fluid reservoir, and accompanying pump. Accordingly, the stroke of each of the pistons and cylinders can be individually varied by the operator of the invention. The hydraulic control mechanism may specifically include various, separate valves or gates for selectively varying the fluid to each piston and cylinder.

It will be readily apparent to one of skill in the art that although the preferred embodiment is able to remove ties, the process can also be reversed for the insertion of ties below a particular set of parallel rails. To accommodate this operation, the grippers are similarly secured along the tie and the main cylinder stroke reversed. Accordingly, the tie is "pulled" into position. Moreover, as is shown in FIG. 1, a pulling plate 61 is affixed to the bottom of the gripper apparatus to facilitate insertion of a support tie. Specifically, the pulling apparatus is dropped over the end of the tie at or near the completion of the downward stroke of the main cylinder piston rod. The gripper disks are removed at this point since they will be dangerously close to the track rail. The pulling plate, in effect, "pulls" the tie into position through the remaining downward stroke of the main cylinder piston rod.

Accordingly, the improved device provides a safer and more flexible tie extractor adapted to be conveniently and effectively used with all widths of track and all track configurations.

MODIFICATIONS

Many modifications and changes are, of course, contemplated by the invention, and the invention should not be limited to that disclosed in the preferred embodiment. In particular, the size, shape and material of the spacer can be readily varied. Moreover, the thickness of the spacer components can be varied to accommodate the force generated by a particular main cylinder to ensure safe and efficient operation.

Moreover, the actuators in the preferred embodiment are comprised of pistons and cylinders; however, many other types of actuators could be readily adapted for use with the invention.

Further, various types of retractors and hose reels could be readily incorporated to provide safe operation of the connector hoses during the course of the use of the device. In addition, numerous and various hydraulic systems and control mechanisms could also be adapted to regulate the force generated by each of the actuators and further, to ensure that the device could be disengaged independent of the operation of the engine or other forced generating device used with the invention.

Accordingly, while the presently-preferred form of the improved tie extractor has been shown and described, and several modifications and changes discussed, persons skilled in the art will readily appreciate the various additional changes and modifications may be made without departing from the spirit of the invention, as defined and differentiated by the following claims.

I claim:

1. A device for inserting or removing a support member from beneath a plurality of rails, comprising:

a support frame specially configured to span the distance between a plurality of spaced rails, said rails having a width and configuration and being supported by a plurality of spaced support members, each of said support members spanning the distance between said rails;

rollers, mounted on said support frame and arranged to freely rotate over said rails;

a main piston and cylinder, having a piston rod with a stroke said main cylinder operatively arranged on said support frame such that the direction of said stroke of said piston rod is horizontal, toward and away from said rails;

grippers, operatively connected to said piston rod, adapted to open and close and to be horizontally positioned by the stroke of said piston rod;

a gripper piston and cylinder, having one or more piston rods, adapted to open and close said gripper;

a lift piston and cylinder, having a piston rod, operatively connected to said main piston and cylinder and arranged to selectively vary said direction of said stroke of main cylinder piston rod;

a fluid reservoir for providing a source of fluid;

a motor and fluid pump adapted to provide said fluid from said fluid reservoir to said main piston and cylinder, said gripper piston and cylinder, and said lift piston and cylinder;

control means for regulating the fluid supplied to said main piston and cylinder, said gripper piston and cylinder and said lift piston and cylinder;

track locking means for securing said support frame to one of said rails, said track locking means being adapted to selectively secure said support frame to said rails independent of said rail width or configuration, wherein said track locking means is a plurality of U-shaped spacers adapted to fit over said width of said rail, said spacers being of variable width to accommodate rails of different widths and configurations.

2. A device according to claim 1 wherein said grippers comprise a plurality of cylinderical disks having cleats thereon, said disks operatively arranged in faced spaced relation such that said cleats are adapted to securely grip one of said support members.

3. A device according to claim 1 wherein said control means is comprised of a series of valve and hoses intermediate said fluid reservoir and each of said main piston and cylinder, said gripper piston and cylinder and lift piston and cylinder.

4. The device according to claim 3 and further comprising a retractor adapted to automatically feed and retract said hoses to said gripper piston and cylinder dependent upon said stroke of said main piston and cylinder piston rod.

5. The device according to claim 4 wherein said retractor is a spring-biased reel.

6. The device according to claim 1 wherein said spacers are adapted to fit one within another.

7. The device according to claim 1 and further comprising a release valve for selectively releasing said fluid from said main piston and cylinder, said gripper piston and cylinder and said lift piston and cylinder, independent of said motor and fluid pump.

8. A device for inserting or removing a support member from beneath a plurality of rails, comprising:

a support frame specially configured to span the distance between a plurality of spaced rails, said rails having a width and configuration and being supported by a plurality of spaced support members, each of said support members spanning the distance between said rails;

rollers, mounted on said support frame an arranged to freely rotate over said rails;

a main actuator, including a rod having a stroke said main actuator operatively arranged on said support frame such that the direction of said stroke of said rod is horizontal, toward and away from said rails;

grippers, operatively connected to said main actuator rod, and adapted to open and close and to be horizontally positioned by the stroke of said main actuator rod;

a gripper actuator, having one or more rods with a stroke adapted to open and close said grippers;

a lift actuator, having a rod with a stroke operatively connected to said main actuator and arranged to selectively vary said direction of said stroke of said main actuator rod;

control means for individually actuating each of said actuators and varying the length of said stroke of said rods;

track locking means for securing said support frame to one of said rails, said track locking means being adapted to selectively secure said support frame to said rails independent of said rail width or configuration; wherein said track locking means is a plurality of U-shaped spacers adapted to fit over said width of said rail, said spacers being of variable width to accommodate rails of different widths and configurations.

9. The device according to claim 8 wherein said spacers are adapted to fit one within another.

10. The device according to claim 8 and further comprising a release means for controlling the operation of said actuators and for varying the length of said stroke of said rods independent of said control means.

11. A device for inserting or removing a support member from beneath a plurality of rails, comprising:

a support frame specially configured to span the distance between a plurality of spaced rails, said rails having a width and configuration and being supported by a plurality of spaced support members, each of said support members spanning the distance between said rails;

rollers, mounted on said support frame and arranged to freely rotate over said rails;

a main piston and cylinder, having a piston rod with a stroke length, said main cylinder operatively arranged on said support frame such that the direction of said stroke of said piston rod is horizontal, toward and away from said rails;

grippers, operatively connected to said piston rod, adapted to open and close and to be horizontally positioned by the stroke of said piston rod;

a gripper piston and cylinder, having one or more piston rods, adapted to open and close said grippers;

a lift piston and cylinder, having a piston rod, operatively connected to said main piston and cylinder and arranged to selectively vary said direction of said stroke of said main cylinder piston rod;

a fluid reservoir for providing a source of fluid;

a motor and fluid pump adapted to provide said fluid from said fluid reservoir to said main piston and cylinder, said gripper piston and cylinder, and said lift piston and cylinder;

control means for regulating the fluid supplied to said main piston and cylinder, said gripper piston and cylinder and said lift piston and cylinder;

track locking means for securing said support frame to one of said rails, said track locking means being adapted to selectively secure said support frame to said rails independent of said rail width or configuration and wherein said track locking means is a plurality of U-shaped spacers adapted to fit over said width of said rail, said spacers being of variable width to accommodate rails of different widths and configurations;

whereby said gripping means is secured to said support member and removes or inserts said support member from beneath said rails in response to the horizontal stroke of said main piston and cylinder piston rod.

12. The device according to claim 11 wherein said spacers are adapted to fit one within another.

13. A device for inserting or removing a support member from beneath a plurality of rails, comprising:

a support frame specially configured to span the distance between a plurality of spaced rails, said rails having a width and configuration and being supported by a plurality of spaced support members, each of said support members spanning the distance between said rails;

rollers, mounted on said support frame and arranged to freely rotate over said rails;

a main actuator, including a rod having a stroke length, said main actuator operatively arranged on said support frame such that the direction of said stroke of said rod is horizontal, toward and away from said rails;

grippers, operatively connected to said main actuator rod, and adapted to open and close and to be horizontally positioned by the stroke of said main actuator rod;

a gripper actuator, having one or more rods with a stroke length, adapted to open and close said grippers;

a lift actuator, having a rod with a stroke length, operatively connected to said main actuator and arranged to selectively vary said direction of said stroke of said main actuator rod;

control means for individually actuating each of said actuators and varying the length of said stroke of said rods;

track locking means for securing said support frame to one of said rails, said track locking means being adapted to selectively secure said support frame to said rails independent of said rail width or configuration and wherein said track locking means is a plurality of U-shaped spacers adapted to fit over said width of said rail, said spacers being of variable width to accommodate rails of different widths and configurations;

whereby said gripping means is secured to said support member and removes or inserts said support member from beneath said rails in response to the horizontal stroke of said main actuator rod.

14. The device according to claim 13 wherein said spacers are adapted to fit one within another.

* * * * *